US005119652A

United States Patent [19]

Costa

[11] Patent Number: 5,119,652

[45] Date of Patent: Jun. 9, 1992

[54] ANTI-THEFT SEAL FOR COMMERCIAL ARTICLES HAVING ROD-LIKE PORTIONS

[75] Inventor: Emilio Costa, Cornedo Vicentino, Italy

[73] Assignee: International Plast di Costa Emilio & C. S.n.c., Cornedo Vicentino, Italy

[21] Appl. No.: 695,111

[22] Filed: May 3, 1991

[30] Foreign Application Priority Data

May 10, 1990 [IT] Italy ..... 41592 A/90

[51] Int. Cl.[5] ..... E05B 65/00

[52] U.S. Cl. ..... 70/57.1; 292/307 R

[58] Field of Search ..... 70/14, 57.1, 57-59; 292/307 R, 316, 322, 327, DIG. 11; 24/704.1, 3 C

[56] References Cited

U.S. PATENT DOCUMENTS

| | | | |
|---|---|---|---|
| 4,106,801 | 8/1978 | De Lima Castro Neto | 292/307 R |
| 4,221,025 | 9/1980 | Martens et al. | 24/704.1 X |
| 4,375,298 | 3/1983 | Stoffel | 292/307 R |
| 4,380,097 | 4/1983 | Keifer | 70/57.1 |
| 4,502,717 | 3/1985 | Close | 70/57.1 |
| 4,658,955 | 4/1987 | Eichner | 292/307 R X |
| 4,670,950 | 6/1987 | Wisecup et al. | 70/57.1 |
| 4,805,856 | 2/1989 | Nicoli et al. | 292/307 R X |
| 4,818,002 | 4/1989 | De Lima Castro Netto | 292/307 R |
| 4,878,702 | 11/1989 | Madsen et al. | 292/307 R |

*Primary Examiner*—Renee S. Luebke
*Assistant Examiner*—Suzanne L. Dino
*Attorney, Agent, or Firm*—Guido Modiano; Albert Josif

[57] ABSTRACT

An anti-theft seal for commercial articles having rod-like portions such as spectacles includes a box-like body for containing an electronic indication component. The body has a tab which is constituted by three consecutive elements which are articulated by reducing their cross section so that they can fold back onto the body and define a containment seat for a rod-like element to be secured. A slider engages, in a non-reversible manner, a guide which is rigidly associated with the box-like body; the slider has a mushroom-shaped head which is suitable for inserting, by translatory motion, in a seat of the tab so as to lock it in folded position.

19 Claims, 1 Drawing Sheet

ANTI-THEFT SEAL FOR COMMERCIAL ARTICLES HAVING ROD-LIKE PORTIONS

BACKGROUND OF THE INVENTION

The present invention relates to an anti-theft seal for commercial articles having rod-like portions.

The seal is particularly suitable for engaging the rods of spectacles.

In spectacle sales points it is currently common to secure said spectacles with anti-theft seals capable of activating electronic alarm circuits arranged at the entrances.

Said devices are substantially constituted by small blocks, on the surfaces of which advertising or guarantee inscriptions or trade-marks are generally applied, which have a seat for the insertion of one of the rods of a pair of spectacles and, in said seat, a screw which engages against the surface of the rod so as to lock it.

In this manner, securing occurs by exerting stress on the rod, and this can lead to permanent deformations thereof or even to the spoiling of its outer surface due to the friction of the tip of the screw.

Grip is furthermore not optimum, since action occurs only at one point of the rod, the countless commercially available embodiments whereof may be conical with a taper which decreases from the hinge toward the end or vice versa.

As can be imagined, the screw thus acts on an inclined plane, and its securing is consequently never stable unless the rod is deformed as mentioned above.

SUMMARY OF THE INVENTION

The aim of the present invention is to provide an antitheft seal for spectacles which improves, with respect to known types, its grip on one of the rods so that it cannot be slid off.

A consequent primary object is to provide a seal which can adapt to any type of spectacle rod.

Another important object is to provide an anti-theft seal which can be recovered after selling the spectacles.

Still another object is to provide a seal which is particularly advantageous with respect to known types in terms of price as well.

Still another object is to provide a seal which does not have the risk of damaging in any way the rod to which it is fixed.

Still another object is to provide a seal which can also be applied to other commercial articles having rod-like portions.

Not least object is to provide a seal which can be manufactured with conventional machines and facilities.

This aim, these objects and others which will become apparent hereinafter are achieved by an anti-theft seal for commercial articles having rod-like portions, characterized in that it comprises a box-like body which is suitable for containing an electronic indication component, said body having a tab constituted by three consecutive elements which are articulated by reducing their cross section, so as to be able to fold back onto said body and define a containment seat for a rod-like element to be secured, a slider being provided, said slider engaging, in a non-reversible manner, a guide which is rigidly associated with the box-like body, said slider having a mushroom-shaped head which is suitable for inserting itself, by translatory motion, in a seat of said tab so as to lock it in folded position.

BRIEF DESCRIPTION OF THE DRAWINGS

Further characteristics and advantages of the invention will become apparent from the detailed description of an embodiment thereof, illustrated only by way of non-limitative example in the accompanying drawings, wherein.

DESCRIPTION OF THE PREFERRED EMBODIMENTS

Figure 2:
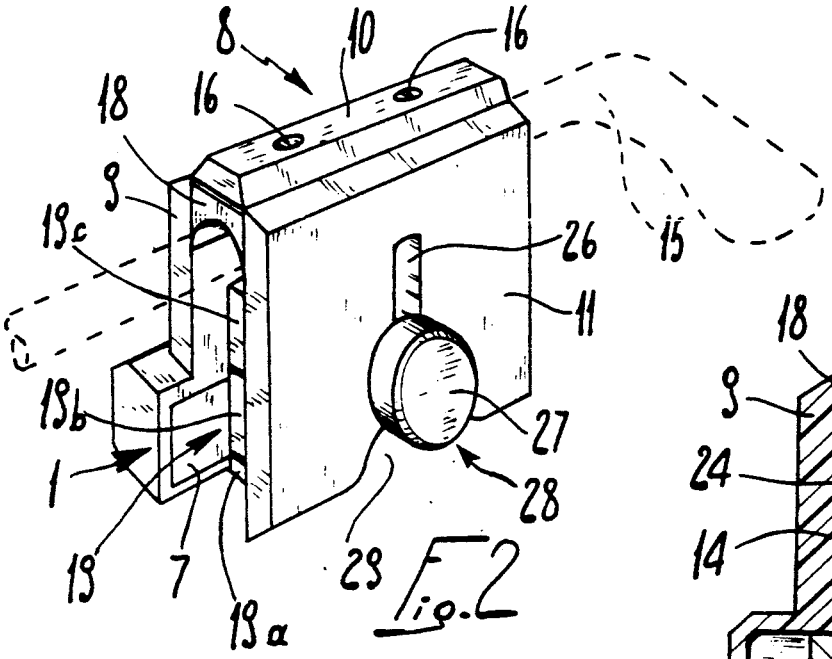
FIG. 2 is a perspective view of the anti-theft seal of FIG. 1 in the configuration for fixing to a spectacle rod.
Figure 3:
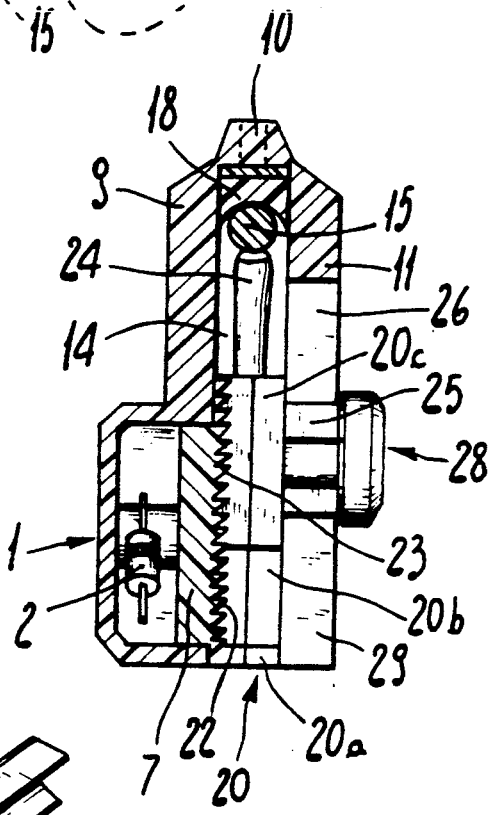
FIG. 3 is a vertical median sectional view of the seal according to the invention in the configuration of FIG. 2.

With reference to the above figures, the anti-theft seal according to the invention comprises a substantially parallelepipedal box-like body 1 made of plastic material which is open at one of its larger faces.

An electronic indication component, for example a high-frequency diode 2, with its terminals 3 and 4, can be conveniently inserted inside said box-like body 1.

The peculiarity of the high-frequency diode 2 resides in the fact that although it has no power supply, when it passes through an electric field provided for example between two plates arranged at an entrance it starts to vibrate at a very high frequency.

This vibration, detected by the electric field itself, is capable of activating a known alarm system.

Conveniently, two tubular lugs 5 extend from the bottom of said box-like body 1, and complementarily shaped cylindrical pins 6, which extend from a cover 7 suitable for closing said box-like body 1 by inserting itself snugly between its walls, can be inserted in said tubular lugs.

As illustrated in the figures, a planar tab 8 extends from the box-like body 1, and one of its larger faces extends and continues from the surface defined at the edges of the walls of the box-like body 1 and of the cover 7.

Said tab 8 is constituted by three consecutive elements, respectively 9, 10, and 11, which are articulated by reducing their cross-section along two hinge lines 12 and 13 which allow folding back onto the box-like body so that the element 11 is parallel to the element 9 and is close thereto.

A containment seat 14 is thus defined for a rod-like element to be secured, which can be for example a rod 15 of a pair of spectacles.

Two transverse holes 16 are conveniently defined on the element 10, and pins 17, which extend from a longitudinal rubber fitting 18, engage in said holes; said fitting 18 has, toward the seat 14, a recess for accommodating the outer surface of the rod 15.

Figure 1:
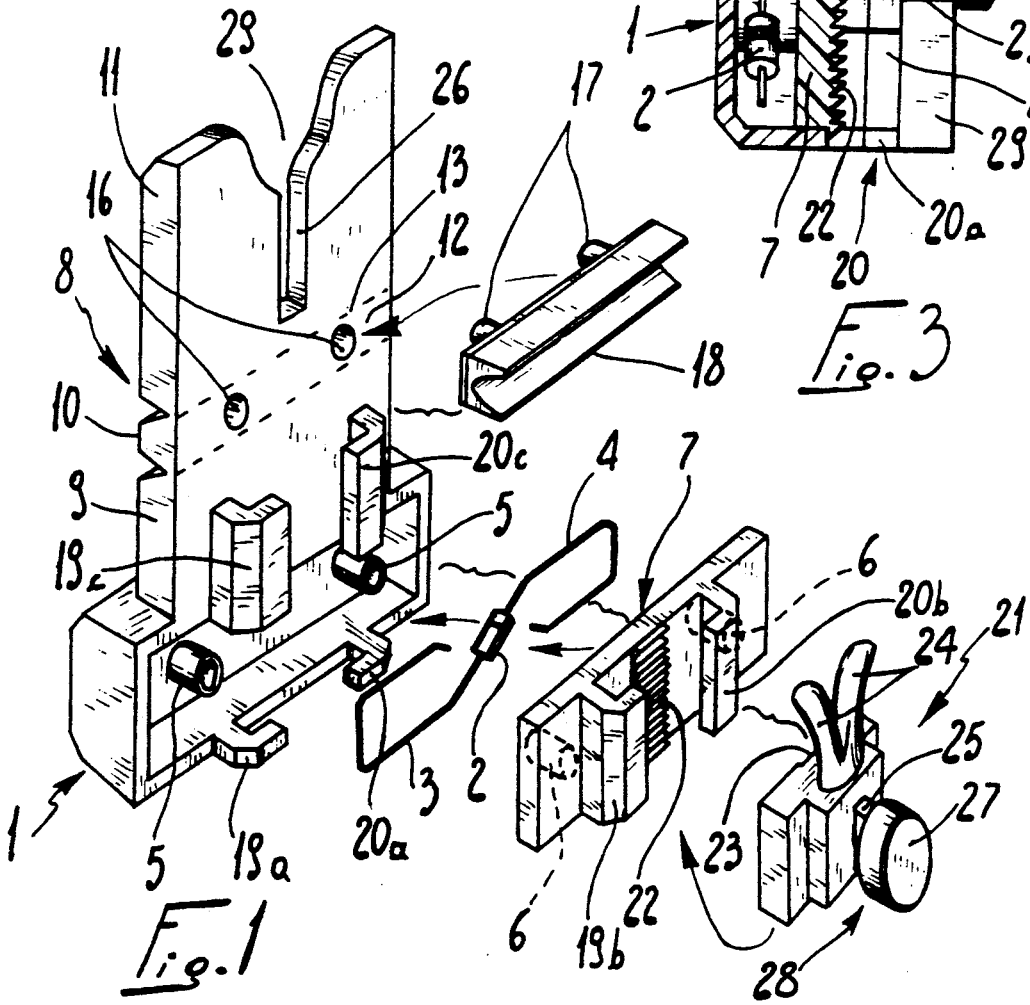
FIG. 1 is an exploded view of the anti-theft seal according to the invention.

By means of said folding, the element 11 rests on two parallel guides 19 and 20 having an angular transverse cross-section, each of which extends with consecutive parts 19*a*, 19*b*, 19*c* and 20*a*, 20*b*, 20*c* respectively from the box-like body 1, from the cover 7 and from the element 9 (see in particular FIG. 1).

A slider 21 which is laterally shaped complementarily to said guides 19 and 20 can be inserted between said guides, and engages, in a non-reversible manner, a sawtooth rack 22 which is arranged on the cover 7 between the guides 19 and 20; said slider is provided with a complementarily shaped rack 23 on its sliding surface.

Two diverging wings 24 extend from said slider 21 and are suitable for entering said seat 14, exerting an elastic pressure on two points of the outer surface of the rod 15, securing it safely to the seal.

At this point it should be noted that a raised portion 25 extends from the slider 21 and is suitable for inserting itself by translatory motion within a slot 26 with which the element 11 is longitudinally provided.

A disk-like element 27 extends from said raised portion 25, forming as a whole a mushroom-shaped head 28, and is thus suitable for keeping the tab 8 locked in folded position.

Advantageously, said slot 26 ends at the end of the element 11 with a widened portion 29 which is suitable for preventing the folding from interfering with the disk-like element 27.

After mounting the seal on the rod 15, said seal can thus be disconnected from said rod only by breaking the disk-like element 27 which allows to open the tab 8.

Since the cover 7 is interposed between the element 11 and the box-like body 1, it cannot be disengaged in any way therefrom to gain access to the electronic indication component.

The particular embodiment of the seal allows to fix it, by means of the wings 24, onto two distinct points of the rod, so as to adapt to the constructive characteristics thereof, which can have various types of taper.

The seal cannot be slid off the rod in any way without first breaking the mushroom-shaped head 28 by means of an appropriate tool with which shopkeepers are provided.

In any case, the breakage of the mushroom-shaped head 28 allows to recover the remaining part of the seal for association with other spectacles.

The presence of the slider 21 allows the seal to adapt in the best manner to any type of rod.

Finally, it should be noted that the seal according to the invention, also by virtue of the presence of the high-frequency diode 2, is extremely advantageous from the point of view of price with respect to known types of seal.

The same seal can naturally also be used for other types of product having rod-like portions.

In practice it has thus been observed that the seal according to the invention has achieved the intended aim and objects.

The invention thus conceived is susceptible to numerous modifications and variations, all of which are within the scope of the inventive concept.

All the details may furthermore be replaced with other technically equivalent elements.

In practice, the materials employed, so long as compatible with the contingent use, as well as the dimensions, may be any according to the requirements.

I claim:

1. Anti-theft seal for commercial articles having rod-like portions, comprising a box-like body which is suitable for containing an electronic indication component, said body having a tab constituted by three consecutive elements which are articulated by reducing their cross section, so as to be able to fold back onto said body and define a containment seat for a rod-like element to be secured, a slider being provided, said slider engaging, in a non-reversible manner, a guide which is rigidly associated with the box-like body, said slider having a mushroom-shaped head which is suitable for inserting itself, by translatory motion, in a seat of said tab so as to lock it in folded position, wherein said box-like body, which is preferably made of plastic material, is substantially shaped like a parallelepiped and has, at one face, an opening for the insertion of said electronic indication component, a cover being insertable and lockable on said opening, and, wherein the non-reversible engagement of said slider with said box-like body is performed by means of a saw-tooth rack which extends from said cover between said guides and is suitable for engaging a complimentarily shaped rack which extends from said slider.

2. Anti-theft seal, according to claim 1, wherein said slider has two diverging wings which are suitable for inserting in said seat for said rod-like element and for pressing on said rod-like element against a fitting which is rigidly associated with the middle one of said articulated consecutive elements which form said tab.

3. An anti theft seal for commercial articles having rod-like portions comprising; a box-like body having an open face, a foldable tab connected to said box-like body, an element defined by said tab and lying opposite said box-like body, a slot formed in said element of said tab, a saw-tooth rack connected to said box-like body opposite said slot, a slider accommodated within said box-like body, a complimentarily shaped rack defined on said slider and engaging said saw-tooth rack, a raised portion connected to said slider and protruding externally of said box-like body through said slot in said tab, an externally accessible head defined by said raised portion for irreversibly moving said slider along said slot and simultaneously moving said complimentarily shaped rack along said saw-tooth rack, and a containment seat defined between said slider and said box-like body for accommodating at least a portion of a rod-like portion of a commerical article.

4. Anti theft seal according to claim 3, wherein said anti-theft seal further comprises an electronic indication component housed within said box-like body.

5. Anti theft seal according to claim 3, wherein said tab has formed thereon at least two portions having a reduced cross-sectional area, said tab being folded at said at least two portions to close said open face of said box-like body.

6. Anti theft seal according to claim 3, wherein said electronic indication component comprises at least one high-frequency diode having at least two terminals.

7. Anti theft seal according to claim 3, further comprising a bottom defined by said box-like body, at least two tubular lugs protruding from said bottom inside said box-like body, a cover having defined thereon said saw-tooth rack, and complimentarily shaped pins extending from said cover and being insertable into said tubular lugs, whereby to connect said cover to said box-like body.

8. Anti theft seal according to claim 3, further comprising at least one longitudinal fitting, at least two transverse holes defined opposite said slider in said containment seat, and pins extending from said longitudinal fitting and engaging said transverse holes, whereby at least a portion of a rod-like portion of a commercial article is accommodatable within said containment seat between said longitudinal fitting and said slider.

9. Anti theft seal according to claim 7, wherein said cover, said box-like body and said tab each have connected thereto at least two guides, said saw-tooth rack being defined between said at least two guides connected to said cover.

10. Anti theft seal according to claim 3, further comprising at least two diverging wings, said wings extending from said slider and being positioned within said containment seat, for exerting elastic pressure on at least two points of a portion of a rod-like portion of a commercial article contained therein.

11. Anti theft seal according to claim 3, wherein said raised portion of said slider protruding through said slot is breakable for permitting unfolding of said tab and release of a rod-like portion of a commercial article contained in said containment seat.

12. Anti theft seal according to claim 11, wherein said raised portion of said slider comprises a disk-like element.

13. An anti theft seal for commercial articles having rod-like portions comprising; a box-like body having an open face, a foldable tab connected to said box-like body, an element defined by said tab and lying opposite said box-like body, a slot formed in said element of said tab, a saw-tooth rack connected to said box-like body opposite said slot, a slider accommodated within said box-like body, a complimentarily shaped rack defined on said slider and engaging said saw-tooth rack, a raised portion connected to said slider and protruding externally of said box-like body through said slot in said tab, an externally accessible head defined by said raised portion for irreversibly moving said slider along said slot and simultaneously moving said complimentarily shaped rack along said saw-tooth rack, and a containment seat defined between said slider and said box-like body for accommodating at least a portion of a rod-like portion of a commercial article, wherein said anti-theft seal further comprises an electronic indication component housed within said box-like body, wherein said tab has formed thereon at least two portions having a reduced cross-sectional area, said tab being folded at said at least two portions to close said open face of said box-like body, and wherein said raised portion of said slider protruding through said slot is breakable for permitting unfolding of said tab for releasing a rod-like portion of a commercial article contained in said containment seat.

14. Anti theft seal according to claim 13, wherein said electronic indication component comprises at least one high-frequency diode having at least two terminals.

15. Anti theft seal according to claim 13, further comprising a bottom defined by said box-like body, at least two tubular lugs protruding from said bottom inside said box-like body, a cover having defined thereon said saw-tooth rack, and complimentarily shaped pins extending from said cover and being insertable into said tubular lugs, whereby to connect said cover to said box-like body.

16. Anti theft seal according to claim 13, further comprising at least one longitudinal fitting, at least two transverse holes defined opposite said slider in said containment seat, and pins extending from said longitudinal fitting and engaging said transverse holes, whereby at least a portion of a rod-like portion of a commercial article is accommodatable within said containment seat between said longitudinal fitting and said slider.

17. Anti theft seal according to claim 15, wherein said cover, said box-like body and said tab each have connected thereto at least two guides, said saw-tooth rack being defined between said at least two guides connected to said cover.

18. Anti theft seal according to claim 13, further comprising at least two diverging wings, said wings extending from said slider and being positioned within said containment seat, for exerting elastic pressure on at least two points of a portion of a rod-like portion of a commercial article contained therein.

19. Anti theft seal according to claim 13, wherein said raised portion of said slider comprises a disk-like element.

* * * * *